US009824577B2

(12) United States Patent
Musham et al.

(10) Patent No.: US 9,824,577 B2
(45) Date of Patent: Nov. 21, 2017

(54) METHOD AND APPARATUS FOR CONTROLLING DEVICE

(71) Applicant: Samsung Electronics Co., Ltd., Suwon-si, Gyeonggi-do (KR)

(72) Inventors: Venu Madhav Musham, Bangalore (IN); Arif Husen Mujawar, Karnataka (IN); Kiran Bharadwaj Vedula, Bangalore (IN); Deepraj Prabhakar Patkar, Bangalore (IN)

(73) Assignee: Samsung Electronics Co., Ltd., Suwon-si (KR)

( * ) Notice: Subject to any disclaimer, the term of this patent is extended or adjusted under 35 U.S.C. 154(b) by 92 days.

(21) Appl. No.: 14/167,061

(22) Filed: Jan. 29, 2014

(65) Prior Publication Data

US 2014/0218181 A1 Aug. 7, 2014

(30) Foreign Application Priority Data

Feb. 1, 2013 (IN) ..... 441/CHE/2013
Jan. 8, 2014 (KR) ..... 10-2014-0002492

(51) Int. Cl.
*G08C 19/16* (2006.01)
*G08C 17/02* (2006.01)

(52) U.S. Cl.
CPC ..... *G08C 17/02* (2013.01); *G08C 2201/71* (2013.01); *G08C 2201/91* (2013.01); *G08C 2201/93* (2013.01)

(58) Field of Classification Search
CPC ..... G08C 17/02; G08C 2201/71; G08C 2201/91–2201/93
See application file for complete search history.

(56) References Cited

U.S. PATENT DOCUMENTS

| | | | | |
|---|---|---|---|---|
| 7,751,834 | B2 | 7/2010 | Park et al. | |
| 9,154,910 | B2 * | 10/2015 | Luo | H04W 4/12 |
| 2011/0080120 | A1 * | 4/2011 | Talstra | G08C 17/02 315/312 |
| 2011/0136441 | A1 | 6/2011 | Son et al. | |
| 2011/0319086 | A1 * | 12/2011 | Katori | H04W 48/08 455/440 |

FOREIGN PATENT DOCUMENTS

KR 10-2010-0020147 A 2/2010

* cited by examiner

*Primary Examiner* — Omeed Alizada
(74) *Attorney, Agent, or Firm* — Jefferson IP Law, LLP

(57) ABSTRACT

A method in which a control device controls at least one of a plurality of terminal devices is provided. The method includes transmitting a search request for requesting information on a location of each of a plurality of terminal devices, and information on a direction of each of the plurality of terminal devices based on a direction in which the control device is directed, receiving a response corresponding to the transmitted search request, determining at least one of the plurality of terminal devices that are controllable from among the plurality of terminal devices based on the received response, and controlling the determined at least one of the plurality of terminal devices that are controllable.

20 Claims, 10 Drawing Sheets

METHOD AND APPARATUS FOR CONTROLLING DEVICE

CROSS-REFERENCE TO RELATED APPLICATION(S)

This application claims the benefit under 35 U.S.C. §119 (a) of an Indian patent application filed on Feb. 1, 2013 in the Indian Intellectual Property Office and assigned Serial number 441/CHE/2013, and a Korean patent application filed on Jan. 8, 2014 in the Korean Intellectual Property Office and assigned Serial number 10-2014-0002492, the entire disclosure of each of which is hereby incorporated by reference.

TECHNICAL FIELD

The present disclosure relates to a method of controlling a device and an apparatus thereof.

BACKGROUND

Currently, a technology that one device to control another device at a remote distance is in use. In particular, when there are multiple devices that may be controlled at a remote distance, a user may select any one of the devices to control the same.

However, a process for selecting one of the devices is complicated.

Accordingly, a method that helps a user to easily select one of devices that the user wants to control is provided.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method of controlling a device and an apparatus thereof. With regard to control of a terminal device, there is provided a method of easily selecting a device that a user wants to control by using information on a location of the terminal device.

Additional aspects will be set forth in part in the description which follows and, in part, will be apparent from the description, or may be learned by practice of the presented embodiments.

In accordance with an aspect of the present disclosure, a method in which a control device controls at least one of a plurality of terminal devices is provided. The method includes transmitting a search request for requesting information on a location of the plurality of terminal devices, and information on a direction of each of the plurality of terminal devices based on a direction in which the control device is directed, receiving a response corresponding to the transmitted search request, determining at least one of the plurality of terminal devices that are controllable from among the plurality of terminal devices based on the received response, and controlling the determined at least one of the plurality of terminal devices that are controllable.

In accordance with another aspect of the present disclosure, a control device of controlling at least one of a plurality of terminal devices is provided. The control device includes a search request transmission unit configured to transmit a search request requesting information on a location of each of the plurality of terminal devices, and information on a direction of each of the plurality of terminal devices based on a direction in which the control device is directed, a response reception unit configured to receive a response corresponding to the transmitted search request, a control terminal determination unit configured to determine at least one of the plurality of terminal devices that are controllable from among the plurality of terminal devices based on the received response, and a terminal device control unit configured to control the determined at least one of the plurality of terminal devices that are controllable.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalent.

It is to be understood that the singular forms "a", "an" and "the" include plural referents unless the context clearly dicates otherwise. Thus, for example, reference to "a component surface" includes reference to one or more of such surfaces.

Figure 1:
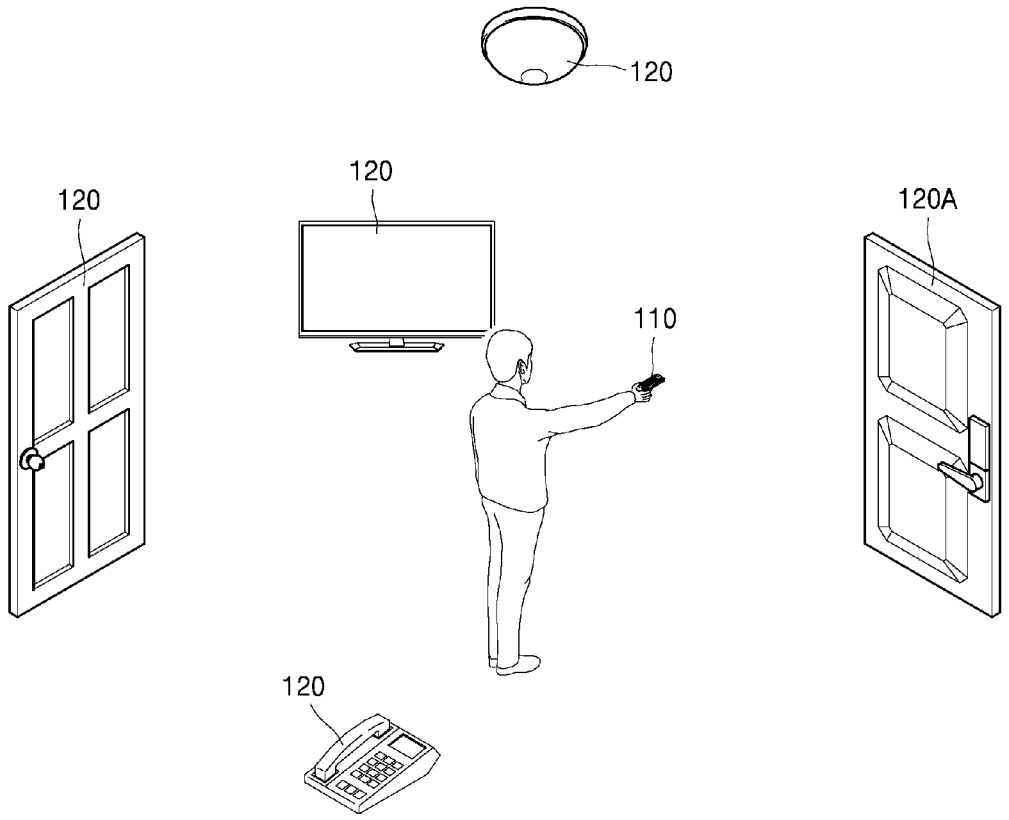
FIG. 1 is a diagram illustrating a method in which a control device controls terminal devices according to an embodiment of the present disclosure.

FIG. 1 is a diagram illustrating a method in which a control device 110 controls terminal devices 120 and 120A according to an embodiment of the present disclosure.

The control device 110 may be used to control a certain terminal device 120A from among a plurality of terminal devices 120. The terminal devices 120 may be positioned around the control device 110.

The control device 110 may select the certain terminal device 120A that is subject to be controlled from among the terminal devices 120. In this case, the selected terminal device 120A may be positioned in a range of a configured angle from a direction in which the control device 110 is directed.

The terminal device 120A that the control device 110 controls may be positioned at a configured distance from the control device 110.

Figure 2:
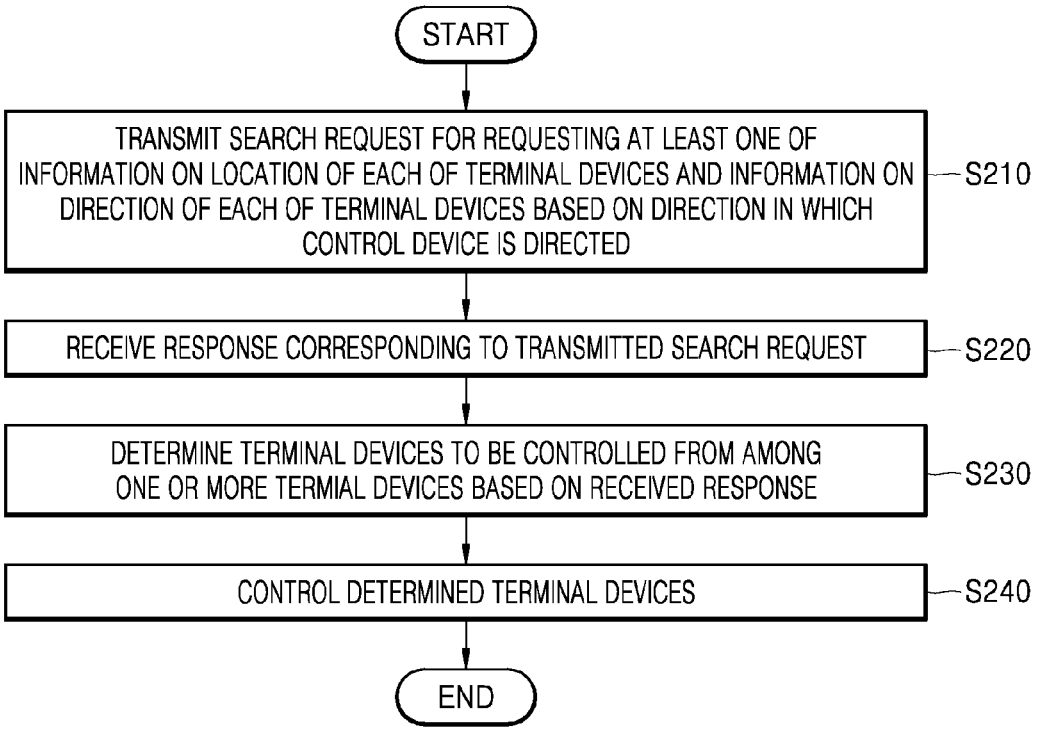
FIG. 2 is a flowchart illustrating a method in which a control device controls terminal devices according to the embodiment of the present disclosure.

FIG. 2 is a flowchart illustrating a method in which the control device 110 controls the terminal devices 120 according to the embodiment of the present disclosure.

In operation S210, the control device 110 may transmit a search request for requesting at least one of information on locations of the terminal devices 120, and information on directions of the terminal devices 120 based on the direction in which the control device 110 is directed.

The information on the locations of the terminal devices 120 may include at least one of information received from a Global Positioning System (GPS), and information received from an Indoor Positioning System (IPS).

The control device 110 may transmit the search request for requesting the information on the locations of the terminal devices 120 to the terminal devices 120 by using a server. The information on the location of each of the terminal devices 120 may include information indicating an absolute location of each of the terminal devices 120. Also, the information on the location of each of the terminal devices 120 may include information with regard to a distance between each of the terminal devices 120 and the control device 110.

The control device 110 may transmit the search request for requesting the information on the direction of each of the terminal devices 120 through a server. The information on the direction of each of the terminal devices 120 may be information based on the direction in which the control device 110 is directed. Also, the information on the direction of each of the terminal devices 120 may include information with regard to an angle that is formed by a direction in which the control device 110 is directed and a direction from the control device 110 to each of the terminal devices 120.

The information with regard to the angle may be obtained by determining the direction in which the control device 110 is directed as a standard direction, and then by measuring a value of an angle from the determined standard direction to the direction indicating the location of each of the terminal devices 120 in a clockwise or counterclockwise direction.

Also, transmission of the search request may be performed through a network. The network may include at least one of Universal Plug and Play (UPnP), Digital Living Network Alliance (DLNA), and ZigBee.

In operation S220, the control device 110 may receive a response corresponding to the search request transmitted in operation S210.

The terminal devices 120 that respond to the search request of the control device 110 may include all the terminal devices 120 connected to the control device 110.

Alternatively, the terminal devices 120 that respond to the search request of the control device 110 may be a portion of the terminal devices 120. The terminal devices 120 that respond to the search request of the control device 110 may be the terminal devices 120 that meet configured standards. In this regard, the configured standards may be determined based on at least one of the direction in which the control device 110 is directed and the location of each of the terminal devices 120.

For example, only the terminal devices 120 positioned within a configured angle from the direction in which the control device 110 is directed may transmit the response corresponding to the search request transmitted by the control device 110.

Also, the control device 110 may receive the response corresponding to the search request transmitted in operation S210 via a network. In this case, the network may include at least one of UPnP, DLNA, and ZigBee.

The response received by the control device 110 in operation S220 may include information on the location and direction of each of the terminal devices 120.

In operation S230, the control device 110 may determine the terminal devices 120 to be controlled from among the terminal devices 120 on the basis of the response received in operation S220.

The control device 110 may determine that the terminal devices 120 positioned within the range of the configured angle from the direction in which the control device 110 is directed as the terminal devices 120 to be controlled.

Alternatively, the control device 110 may determine the terminal devices 120 positioned within the configured distance from the control device 110 as the terminal devices 120 to be controlled.

The control device 110 may receive responses from all of the terminal devices 120, and may determine the terminal devices 120 to be controlled. Alternatively, the control device 110 may receive responses from a portion of the terminal devices 120, and may determine the terminal devices 120 to be controlled.

In operation S240, the control device 110 may control the terminal devices 120 that are determined in operation S230. The control device 110 may transmit a control signal via a network in order to control the terminal devices 120.

Figure 3:
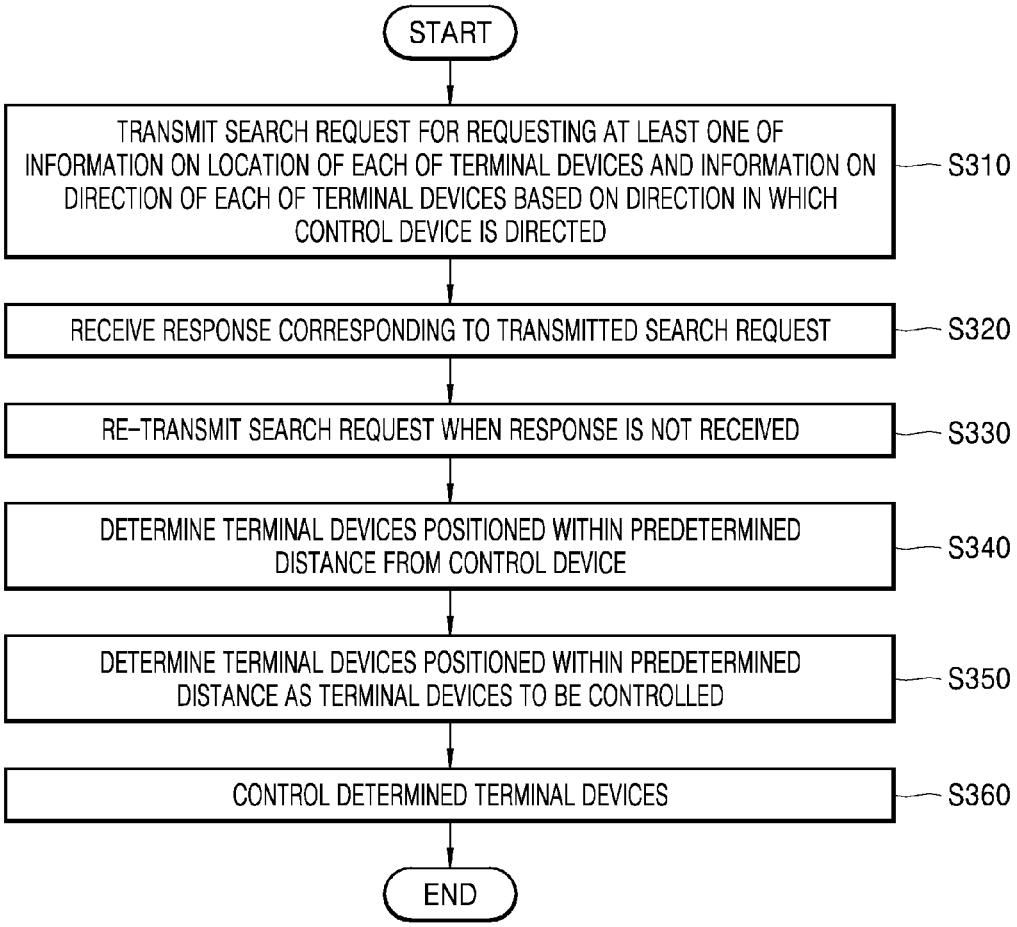
FIG. 3 is a flowchart illustrating a method in which a control device determines terminal devices positioned within a configured distance from the control device, and controls the determined terminal devices according to an embodiment of the present disclosure.

FIG. 3 is a flowchart illustrating a method in which the control device 110 determines and controls the terminal devices 120 positioned within a configured distance from the control device 110 according to an embodiment of the present disclosure.

Referring to FIG. 3, the method of controlling the terminal devices 120 according to the present embodiment may include some of operations described with reference to FIG. 2. Although the repeated descriptions are omitted, the descriptions that are provided with reference to FIG. 2 may also be applied to the method to be described with reference to FIG. 3.

Operations S310, S320, and S360 respectively correspond to operations S210, S220, and S240 so that the detailed descriptions will be omitted to simplify the entire descriptions of the present embodiment.

In operation S330, the control device 110 may re-transmit the search request when no responses are received in operation S320.

A method of re-transmitting the search request of the control device 110 may be understood by referring to the method of transmitting the search request of the control device 110 in operation S320.

In operation S340, the control device 110 may determine the terminal devices 120 positioned within a configured distance from the control device 110. The control device 110 may use information on the location of the control device 110 and information on the location of each of the terminal devices 120 in order to determine whether the terminal devices 120 are positioned within the configured distance from the control device 110. The information on the location of each of the terminal devices 120 may be received from the terminal devices 120 in operation S320 or S330.

Alternatively, the control device 110 may obtain information on a distance between each of the terminal devices 120 and the control device 110 by using the information on the location of each of the terminal devices 120. The control device 110 may determine the terminal devices 120 positioned within the configured distance from the control device 110 from among the terminal devices 120 by using the obtained information on the distance between each of the terminal devices 120 and the control device 110.

In operation S350, the control device 110 may determine the terminal devices 120 positioned within the configured distance from the control device 110 as the terminal devices 120 to be controlled. In this case, the configured distance may be determined according to types of the control device 110 and/or the terminal devices 120. Also, the configured distance may be determined according to a type of networks.

Alternatively, in operation S350, the control device 110 may determine one of the terminal devices 120 from among the terminal devices 120 positioned within the configured distance from the control device 110 as the terminal devices 120 to be controlled.

For example, the control device 110 may determine one of the terminal devices 120, which meets configured conditions other than a distance condition, as the terminal devices 120 to be controlled from among the terminal devices 120 positioned within a configured distance of 1 m from the control device 110. The other configured conditions other than the distance condition may be types of information that a user inputs to the control device 110.

For example, when the control device 110 receives an input regarding opening/closing a door, the control device 110 may determine the door positioned within one-meter radius as the terminal devices 120.

Figure 4:
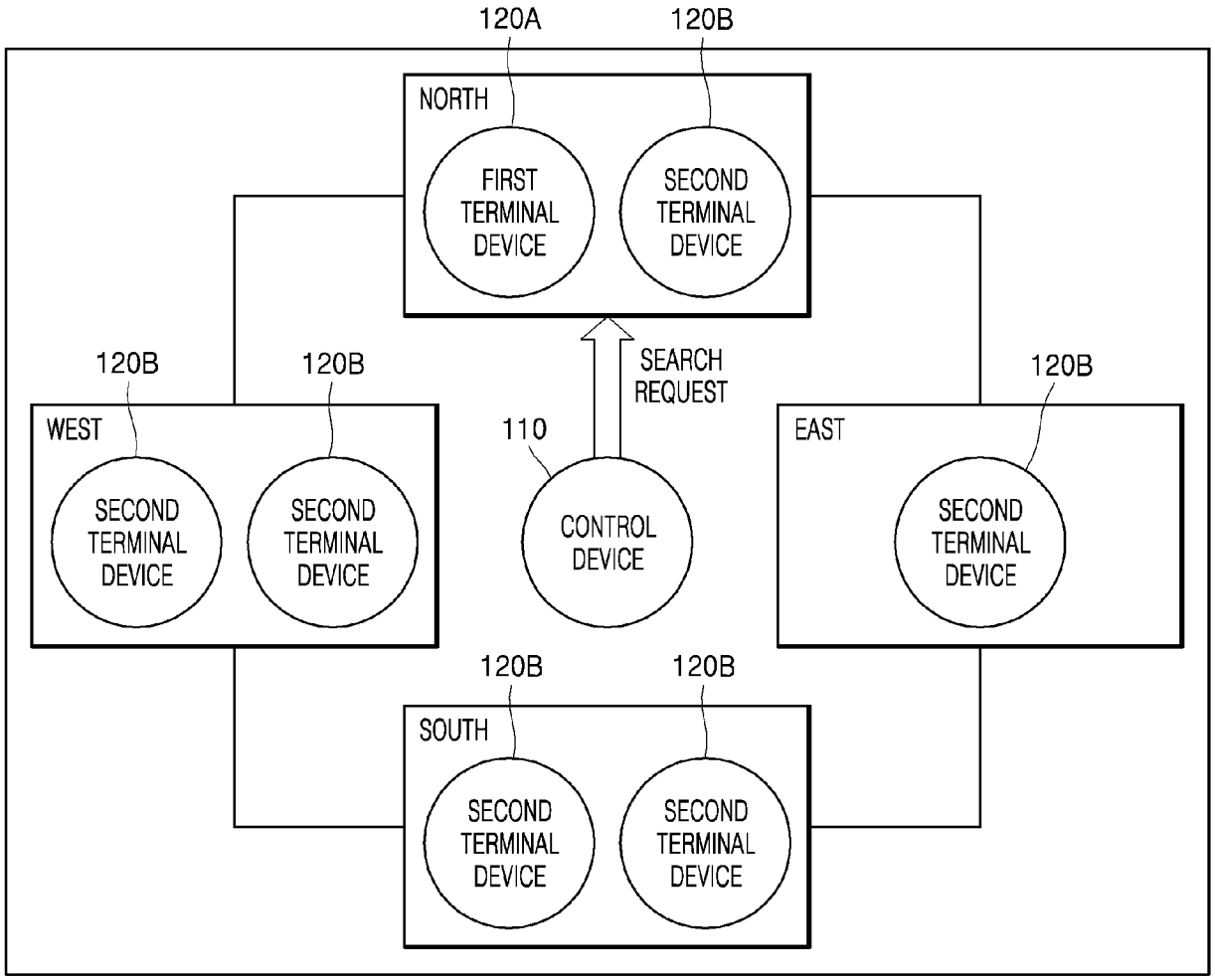
FIG. 4 is a diagram illustrating a method in which a control device controls terminal devices according to an embodiment of the present disclosure.

FIG. 4 is a diagram illustrating a method in which the control device 110 controls the terminal devices 120 according to an embodiment of the present disclosure.

The terminal devices 120 may be positioned around the control device 110. The terminal devices 120 may be classified into a first terminal device 120A that is controlled by the control device 110 and a second terminal device 120B that is not controlled by the control device 110. The first terminal device 120A may be controlled by the control device 110. Among the terminal devices 120, the first terminal device 120A that is controlled by the control device 110 may be positioned within a configured angle from the direction in which the control device 110 is directed. It will be understood, that the first terminal device 120A is in a relative direction (i.e., NORTH) from the current direction in which the control device 110 is directed. The second terminal devices 120B in each of a relative direction of NORTH, EAST, SOUTH and WEST from the current direction in which the control device 110 is directed are not controlled by the control device 110.

The control device 110 and the terminal devices 120 may be connected to each other through a network. Therefore, the control device 110 and one of the terminal devices 120 may receive or transmit data to or from each other via the network. In this regard, the network may include at least one of UPnP, DLNA, and ZigBee. Also, the network may be formed of a combination of UPnP, DLNA, and ZigBee.

According to the present embodiment, two devices positioned at a relative location (i.e., NORTH) may respond to a request of the control device 110. Alternatively, one device 120A of the two devices positioned at the relative location (i.e., NORTH) may respond to the control device 110. The present embodiment may be performed in a situation that the terminal devices 120 are concentrated.

When the control device 110 searches for a neighboring device list, the control device 110 may not obtain a list of all neighboring devices, but may only obtain a list of devices for which the control device 110 needs to search.

For example, it is assumed that a user stays in a meeting room where there are a smart phone and a projector. When the user searches for devices by using the smart phone, all the neighboring devices inside and outside the meeting room may respond to the smart phone. However, the user wants to connect the smart phone to the projector. Accordingly, the user may make the smart phone directed towards a certain direction for connection to the device. With consideration for the directivity, the smart phone may obtain a device list regarding to the projector that is directed to the certain direction.

Some of the terminal devices 120 are subject to be controlled by the control device 110, and are selected by the control device 110. When the control device 110 selects the first device 120A to be controlled, the direction of the first device 120A may be considered. For example, when the control device 110 is directed towards a certain screen, and receives a control signal to play a certain film, the certain film may be displayed on the certain screen. Also, after the control device 110 and the first device 120A are connected to each other, various operations may be performed in the first device 120A.

For example, the user may holds up the smart phone towards a front door, and controls the front door to be open or closed. In this case, a ZigBee direction control device may be used. When the smart phone is directed towards the front door, the smart phone only controls the front door, and other doors may not be controlled by the smart phone.

Figure 5:
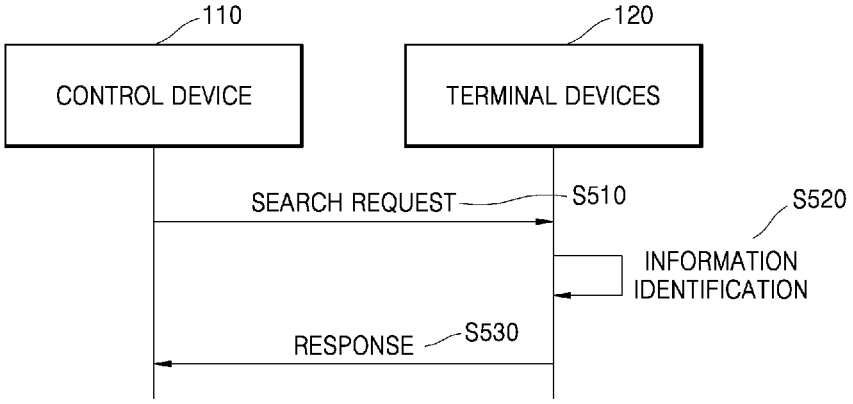
FIG. 5 is a flowchart illustrating a method in which a control device controls terminal devices when the control device transmits a search request to the terminal devices according to an embodiment of the present disclosure.

FIG. 5 is a flowchart illustrating a method in which the control device 110 controls the terminal devices 120 when the control device 110 transmits a search request to the terminal devices 120 according to an embodiment of the present disclosure.

In operation S510, the control device 110 may transmit the search request to the terminal devices 120.

In operation S520, the terminal devices may check relevant information. The relevant information may mean information related to the locations and directions of the terminal devices 120 corresponding to the search request received from the control device 110.

In operation S530, the control device 110 may receive the response from the terminal devices 120. Alternatively, in operation S530, the terminal devices 120 may respond to the control device 110 by updating information on the locations of the terminal devices 120.

The information on the locations of the terminal devices 120 may be determined according to methods described below.

First, when the locations of the terminal devices 120 are set to be fixed, a process for searching for the locations of the terminal devices 120 may not be required.

Second, when the terminal devices 120 are positioned outside, the locations of the terminal devices 120 may be identified via a GPS.

Lastly, when the terminal devices 120 are positioned inside, the locations of the terminal devices 120 may be identified via an IPS. The IPS may use information on a location of a fixed device positioned inside in order to identify the locations of the terminal devices 120.

Figure 6:
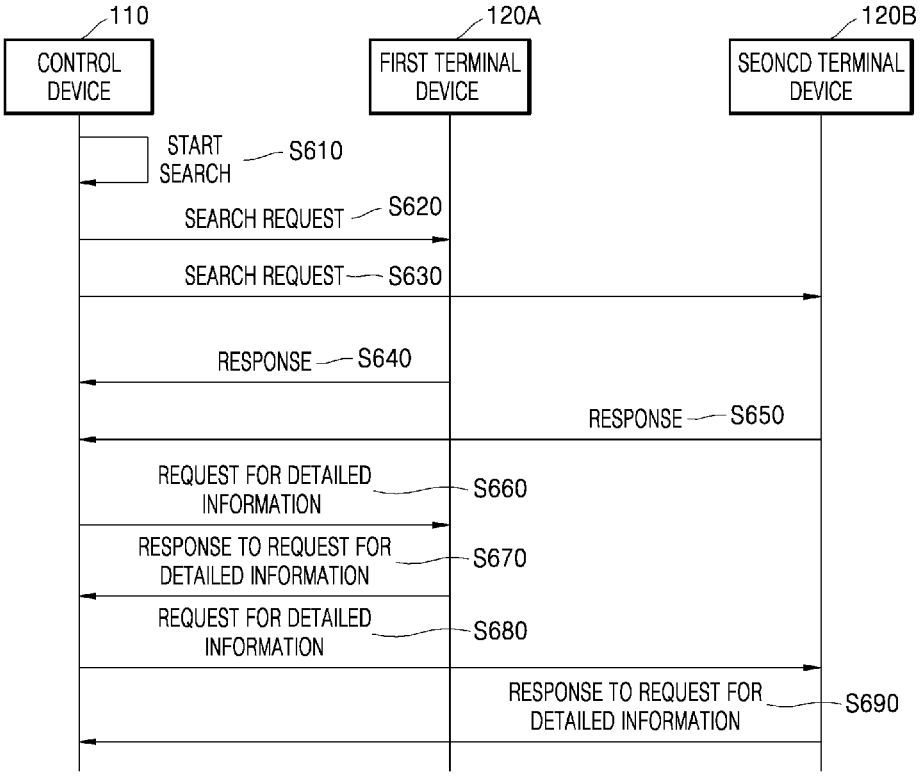
FIG. 6 is a flowchart illustrating a method in which a control device controls terminal devices when the control device transmits a request for requesting detailed information to the terminal devices according to an embodiment of the present disclosure.

FIG. 6 is a flowchart illustrating a method in which the control device 110 controls the terminal devices 120 when the control device 110 transmits a request for requesting detailed information to the terminal devices 120 according to an embodiment of the present disclosure.

In operation S610, the control device 110 may start a search.

In operation S620, the control device 110 may transmit a search request to the first terminal device 120A. Also, in operation S630, the control device 110 may transmit the search request to the second terminal device 120B.

Transmission of the search request may follow a broadcasting method. That is, the search request may be simultaneously transmitted to one or more terminal devices 120.

The search request of the control device 110, which is transmitted to the first or second terminal device 120A or 120B may include the information on the location of the control device 110.

In operation S640, the control device 110 may receive a response from the first terminal device 120A. The response that the control device 110 receives from the first terminal device 120A may include the information on the location of the first terminal device 120A. In addition, the first terminal device 120A may update the information on the location of the first terminal device 120A after receiving the search request from the control device 110.

In operation S650, the control device 110 may receive the response from the second terminal device 120B. The response that the control device 110 receives from the second terminal device 120B may include information on the location of the second terminal device 120B. Also, the second terminal device 120B may update the information on the location of the second terminal device 120B after receiving the search request from the control device 110.

The control device 110 may update the locations of the first and second devices 120A and 120B after receiving the responses from the first and second devices 120A and 120B.

In operation S660, the control device 110 may request the detailed information to the first terminal device 120A. The detailed information may include the information on the location of the first terminal device 120A.

In operation S670, the control device 110 may receive a response to a request for the detailed information from the first terminal device 120A. The first terminal device 120A may identify the location thereof by using a position sensor and a direction sensor. Alternatively, the first terminal device 120A may obtain information related to the location and the direction thereof by using sensors such as a GPS, an IPS, an accelerometer, and a magnetic compass.

The response to the request for the detailed information may include information related to the location, the direction, and the angle of the first terminal device 120A.

In operation S680, the control device 110 may request the detailed information to the second terminal device 120B. The detailed information may include information on the location of the second terminal device 120B.

In operation S690, the control device 110 may receive the response to the request for the detailed information from the second terminal device 120B. The second terminal device 120B may identify the location of the second terminal device 120B by using the position sensor and the direction sensor. Alternatively, the second terminal device 120B may obtain information on the location and the direction of the second terminal device 120B by using sensors such as the GPS, the IPS, the accelerometer, and the magnetic compass.

The response to the request for the detailed information may include information related to the location, the direction, and the angle of the second terminal device 120B.

The control device 110 may request the detailed information to the terminal devices 120 after receiving the response to the search request from the terminal devices 120. The response to the request for the detailed information may include information related to control of the terminal devices 120.

Figure 7:
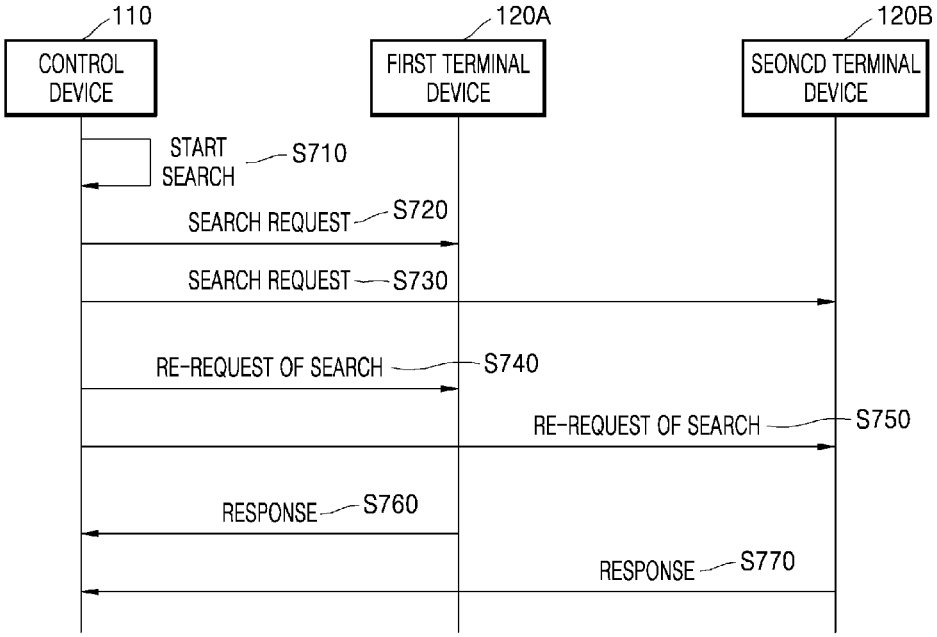
FIG. 7 is a flowchart illustrating a method in which a control device controls terminal devices when the control device re-transmits a search request to the terminal devices according to an embodiment of the present disclosure.

FIG. 7 is a flowchart illustrating a method in which the control device 110 controls the terminal devices 120 when the control device 110 re-transmits a search request to the terminal devices 120 according to an embodiment of the present disclosure.

Operations of S710, S720, S730, S760, and S770 respectively correspond to operations S610, S620, S630, S640, and S650 so that the detailed descriptions will be omitted to simplify the entire descriptions of the present embodiment.

In operation S740, the control device 110 may re-transmit the search request to the first terminal device 120A. The control device 110 may wait for a time period before re-transmitting the search request to the first terminal device 120A. When the control device 110 does not receive a response from the first terminal device 120A for the time period after transmitting the search request to the first terminal device 120A, the control device 110 may re-transmit the search request to the first terminal device 120A.

In operation S750, the control device 110 may re-transmit the search request to the second terminal device 120B. The control device 110 may wait for a time period before re-transmitting the search request to the second terminal device 120B. When the control device 110 does not receive a response from the second terminal device 120B for the time period after transmitting the search request to the second terminal device 120B, the control device 110 may re-transmit the search request to the second terminal device 120B.

Figure 8:
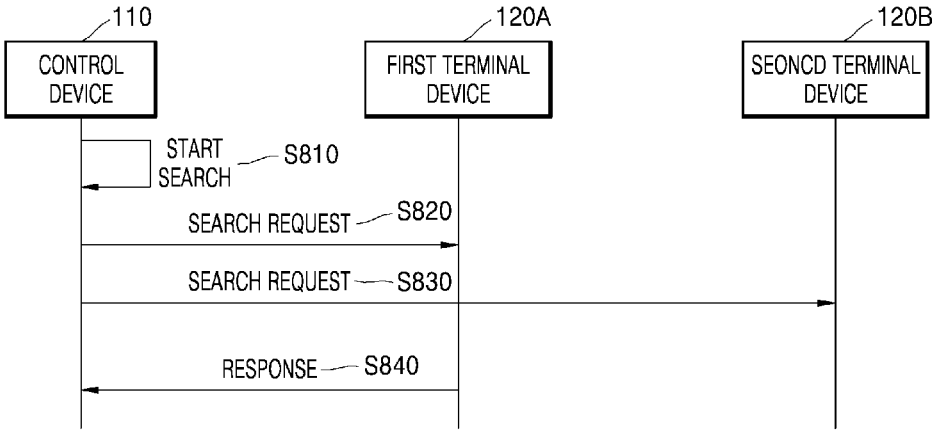
FIG. 8 is a flowchart illustrating a method in which a control device controls terminal devices when some of the terminal devices do not respond according to an embodiment of the present disclosure.

FIG. 8 is a flowchart illustrating a method in which the control device 110 controls the terminal devices 120 when some of the terminal devices 120 do not respond according to an embodiment of the present disclosure.

Operations S810 through S840 respectively correspond to operations S610 through S640 so that the detailed descriptions will be omitted to simplify the entire description of the present embodiment.

According to the present embodiment, the control device 110 may receive a response to the search request form the second terminal device 120B that is subject to be controlled by the control device 110. However, the control device 110 may not receive a response to the search request from the second terminal device 120B that is not subject to be controlled by the control device 110.

Figure 9:
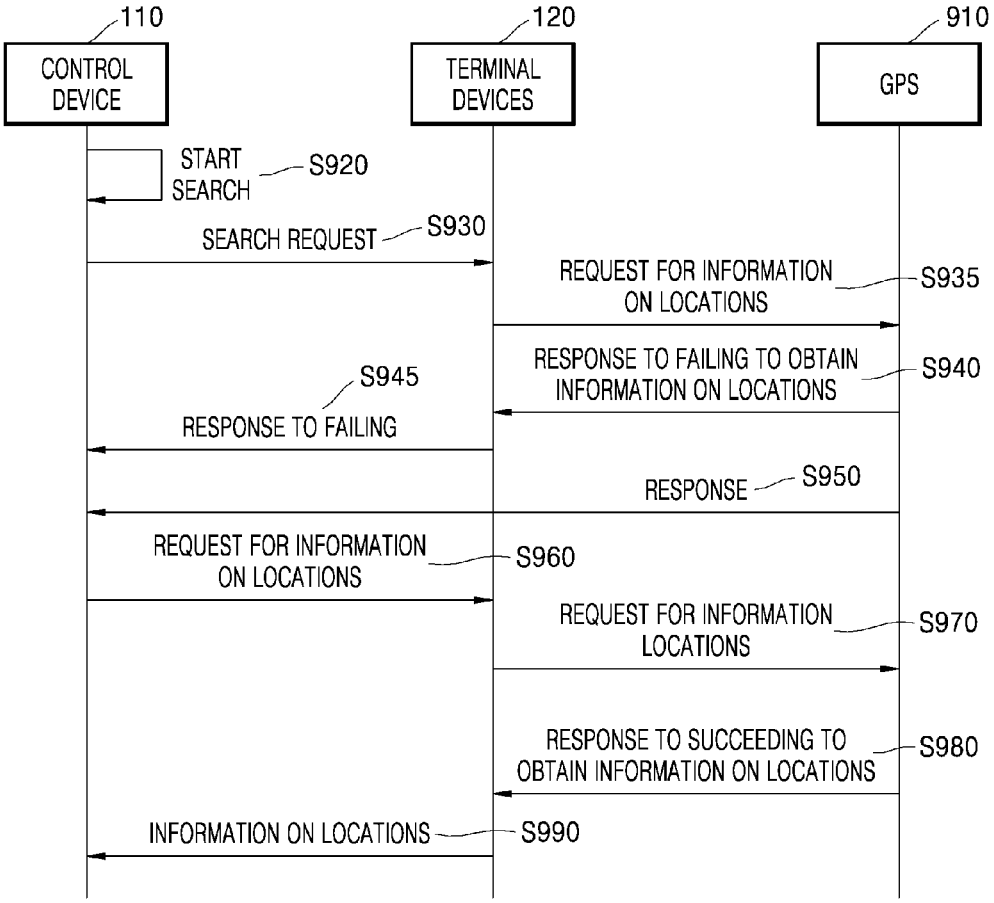
FIG. 9 is a flowchart illustrating a method in which a control device controls terminal devices by using a Global Positioning System (GPS) according to an embodiment of the present disclosure.

FIG. 9 is a flowchart illustrating a method in which the control device 110 controls the terminal devices 120 by using a GPS 910 according to an embodiment of the present disclosure.

In operation S920, the control device 110 may start a search.

In operation S930, the control device 110 may transmit a search request to the terminal devices 120. A method in which the control device 110 transmits the search request to the terminal devices 120 may be understood by referring to the method illustrated in operation S620 of FIG. 6. When the present operation is not performed, the control device 110 may be in a state in which the control device 100 may not obtain information on the location of the terminal devices 120 or the control device 110.

In operation S935, the terminal devices 120 may request the location information to the GPS 910.

In operation S940, when the GPS 910 fails to obtain the information on the locations of the terminal devices 120, the GPS 910 may transmit a response of failing to obtain the information on the locations to the terminal devices 120.

When the GPS 910 is not activated, the GPS 910 may fail to obtain the information on the locations of the control device 110 or the terminal devices 120.

The response of failing to obtain the location information may include information containing a content that the GPS 910 fails to obtain the locations of the terminal devices 120. Alternatively, the response of failing to obtain the location information may be transmitted to the terminal devices 120 as a form of information that includes no location information.

In operation S945, the control device 110 may receive the failing response from the terminal devices 120.

According to set conditions, the control device 110 may receive no responses from the terminal devices 120.

The control device 110 may re-request the location information or the like when receiving the failing response from the terminal devices 120.

In operation S950, the control device 110 may receive a response from the GPS 910. In this regard, the response may include the information on the locations of the terminal devices 120. Alternatively, the response may be a response that notifies that the GPS 910 fails to obtain the information on the locations of the terminal devices 120.

In operation S960, the control device 110 may request the location information to the terminal devices 120. That is, the control device 110 may re-transmit the request to the terminal devices 120 when the control device 110 fails to obtain the location information in operation S945.

In operation S970, the terminal devices 120 may transmit a request for requesting the location information to the GPS 910.

In operation S980, the GPS 910 may transmit a response of succeeding to obtain the location information to the terminal devices 120. The response of succeeding to obtain the location information may be a response that notifies that the GPS 910 succeeds to obtain the information on the locations of the terminal devices 120.

In operation S990, the control device 110 may receive the location information from the terminal devices 120.

The control device may identify the locations of the terminal devices 120 by using the location information received in operation S990.

Figure 10:
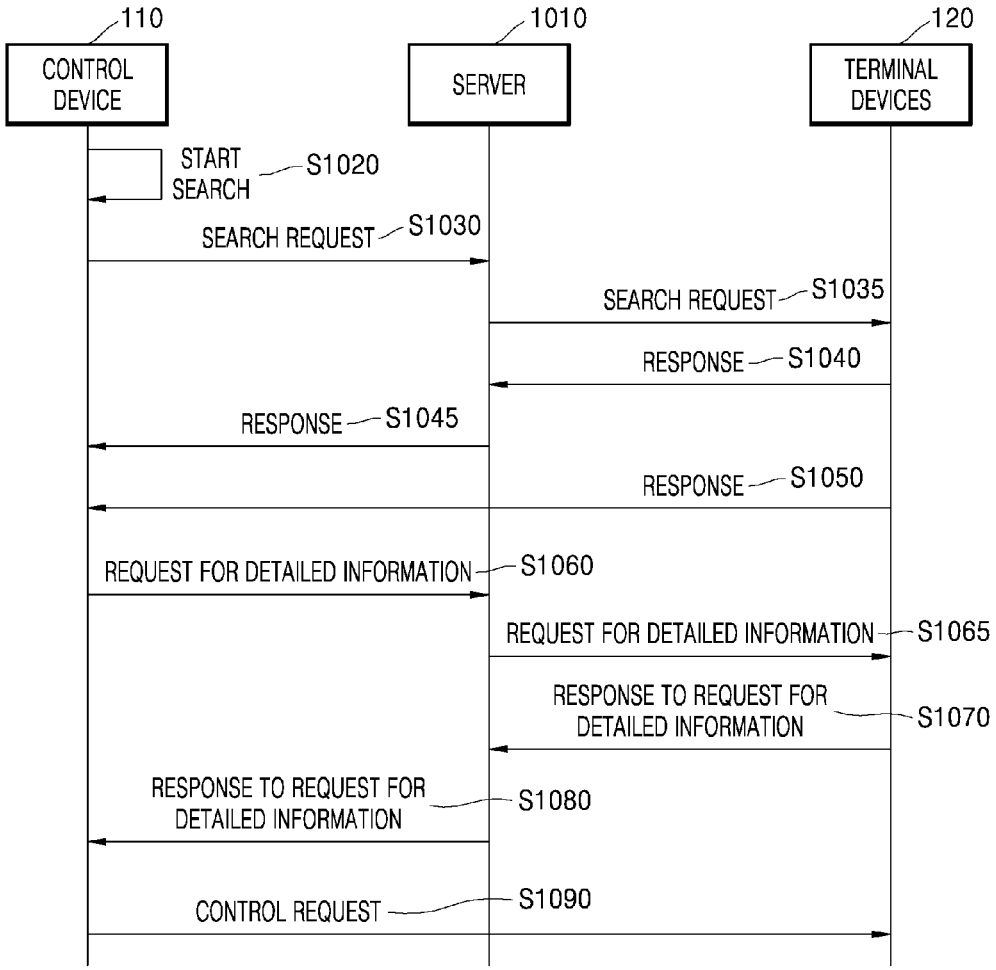
FIG. 10 is a flowchart illustrating a method in which a control device controls terminal devices by using a server according to an embodiment of the present disclosure.

FIG. 10 is a flowchart illustrating a method in which the control device 110 controls the terminal devices 120 by using a server according to an embodiment of the present disclosure.

The control device 110 may search for a content stored in the terminal devices 120 and play the searched content through the server 1010. The content stored in the terminal devices 120 may be played in the control device 110, or in the terminal devices 120.

In operation S1020, the control device 110 may start a search.

In operation S1030, the control device 110 may transmit a search request to the server 1010.

In operation S1035, the server 1010 may transmit the search request to the terminal devices 120.

In operation S1040, the terminal devices 120 may transmit a response to the server 1010.

In operation S1045, the control device 110 may receive the response from the server 1010.

In operation S1050, the control device 110 may receive the response from the terminal devices 120.

In operation S1060, the control device 110 may transmit a request for the detailed information to the server 1010.

In operation S1065, the server 1010 may transmit the request for the detailed information to the terminal devices 120.

In operation S1070, the terminal devices 120 may transmit the response to the request for the detailed information to the server 1010.

In operation S1080, the control device 110 may receive the response to the request for the detailed information from the server 1010.

That is, the control device 110 may browse the server 1010 or the terminal devices 120 by transmitting and receiving the request for the detailed information and the response thereto.

In operation S1090, the control device 110 may transmit a control request to the terminal devices 120. After the terminal devices 120 receives the control request from the control device 110, the terminal devices 120 may perform requested actions such as playing the content, operating a projector, opening a door, and making a call.

Figure 11:
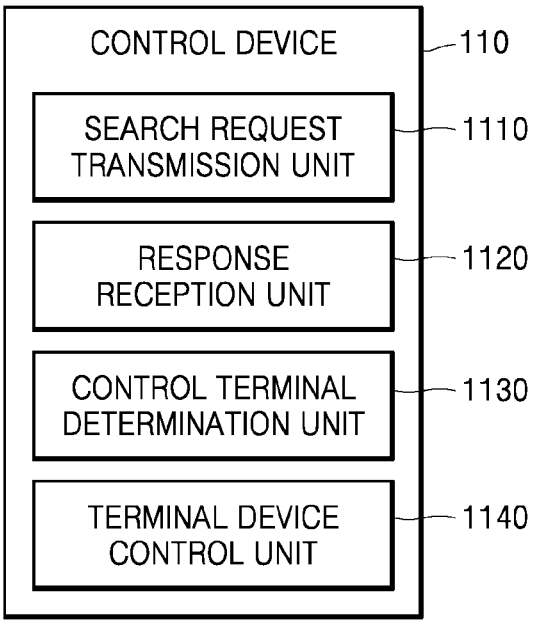
FIG. 11 is a block diagram of a control device according to an embodiment of the present disclosure.
Figure 12:
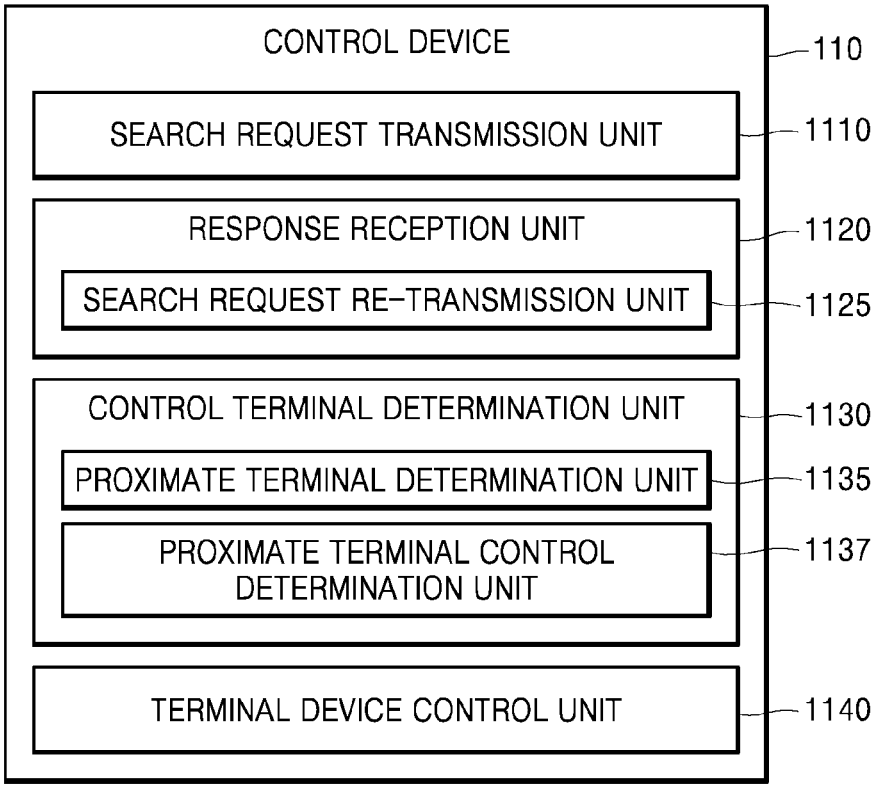
FIG. 12 is a block diagram of a control device according to an embodiment of the present disclosure.
Figure 13:
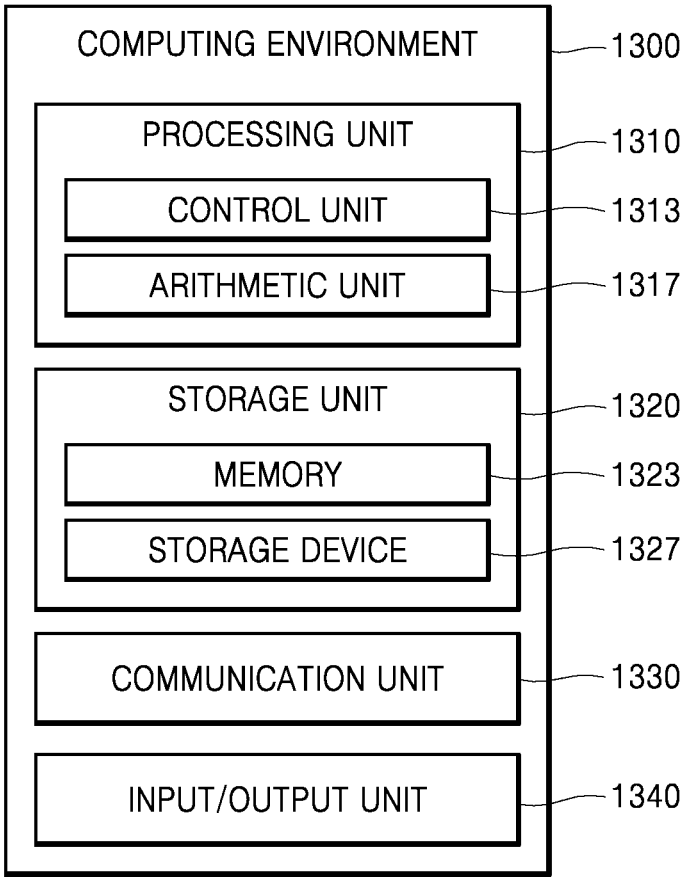
FIG. 13 is a block diagram of a control device according to an embodiment of the present disclosure.

FIGS. 11 through 13 are block diagrams of the control device 110 according to various embodiments of the present disclosure. As described above, the control device 110 is a device of performing the method of controlling the device, and all embodiments for performing the above-described methods may be embodied.

FIG. 11 is a block diagram of the control device 110 according to an embodiment of the present disclosure.

As illustrated in FIG. 11, the control device 110 may include a search request transmission unit 1110, a response reception unit 1120, a control terminal determination unit 1130, and a terminal device control unit 1140. However, not all components are necessary. The present embodiment may be embodied by more components or less components than the components illustrated herein.

Hereinafter, the components will be sequentially described.

The search request transmission unit 1110 may transmit a search request to the terminal devices 120 or the server 1010.

The response reception unit 1120 may receive a response from the terminal devices 120.

The control terminal determination unit 1130 may determine the terminal devices 120 to be controlled from among the terminal devices 120.

The terminal device control unit 1140 may control the terminal devices 120 to be controlled.

FIG. 12 is a block diagram of the control device 110 according to an embodiment of the present disclosure.

A search request re-transmission unit 1125 may be positioned inside the response reception unit 1120.

The search request re-transmission unit 1125 may re-transmit the search request to the terminal devices 120.

A proximate terminal determination unit 1135 and a proximate terminal control determination unit 1137 may be positioned inside the control terminal determination unit 1130.

The proximate terminal determination unit 1135 may determine the terminal devices 120 positioned within a configured distance from the control device 110.

The proximate terminal control determination unit 1137 may determine the terminal devices 120 that are positioned within the configured distance from the control device 110 as the terminal devices 120 to be controlled.

FIG. 13 is a block diagram of the control device 110 according to an embodiment of the present disclosure.

The control device 110 may operate in a computing environment 1300.

As illustrated in FIG. 13, the computing environment 1300 may include a processing unit 1310, a storage unit 1320, a communication unit 1330, and an input/output unit 1340. The computing environment 1300 may be formed of homogeneous or heterogeneous cores, heterogeneous Central Processing Units (CPUs), a media apparatus, and an acceleration apparatus.

Hereinafter, the components will be sequentially described.

The processing unit 1310 may include a control unit 1313, and an arithmetic unit 1317. The processing unit 1310 may receive commands from the control unit 1313 in order to process the commands. The processing unit 1310 may be in charge of processing commands of algorithms. Also, logical and arithmetical computing may be performed in the arithmetic unit 1317.

The processing unit 1310 may be in charge of processing the commands of the algorithms. Also, at least one processing unit 1310 may be positioned on one or more chips.

The storage unit 1320 may include a memory 1323 and a storage device 1327. The storage unit 1320 may store an algorithm formed of commands and codes required to implement the control device 110.

When certain commands are implemented, the certain commands may be transmitted by the memory 1323 and/or the storage device 1327 and may be implemented in the processing unit 1310.

The communication unit 1330 may include networking devices.

The input/output unit 1340 may include input/output devices.

An external device and the computing environment 1300 may be connected through the communication unit 1330 and the input/output unit 1340.

Also, the codes may further include codes related to memory reference, which informs that additional information or media that is required when a computer processor implements the above-described functions Examples of the computer readable recording medium include Read-Only Memory (ROM), Random-Access Memory (RAM), CD-ROMs, magnetic tapes, floppy disks, optical data storage devices, etc.

A computer that can read computer readable medium recording an application that is a program for implementing a method of determining a device location and an apparatus therefore may include general Personal Computers (PCs) such as desktops, and notebook computers, and mobile terminals such as smart phones, tablet PCs, Personal Digital Assistants (PDAs), and mobile communication terminals. Furthermore, the computer may be understood as all the devices capable of computing.

It will be understood that parameters such as configured angle, configured distance or configured standards, may be configured by the user prior to use or during use, or set by the manufacturer of the control device 110 or terminal devices 120 or a combination thereof.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It should be understood that the embodiments described therein should be considered in a descriptive sense only and not for purposes of limitation. Descriptions of features or aspects within each embodiment should typically be considered as available for other similar features or aspects in other embodiments.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method in which a control device controls at least one of a plurality of terminal devices, the method comprising:

transmitting a search request for searching controllable one or more terminal devices from among the plurality of terminal devices;

receiving, from each of the one or more terminal devices, a response corresponding to the transmitted search request, the response including a location of a corresponding terminal device and a first direction in which that an output part of the corresponding terminal device is directed;

determining a second direction in which the control device is directed and a third direction from the control device to the one or more terminal devices based on the location of the corresponding terminal; and determining at least one terminal device that is controllable and positioned within a range of a configured angle based on the first direction, the second direction and the third direction.

2. The method of claim 1, wherein the location of the corresponding terminal device comprises information of a distance between the corresponding terminal device and the control device.

3. The method of claim 2, wherein the determining of the at least one terminal device that is controllable comprises:

determining the one or more terminal devices positioned within a configured distance from the control device; and determining the one or more terminal devices positioned within the configured distance as the at least one terminal device that is controllable.

4. The method of claim 1, wherein the transmitting of the search request is performed via a network, and wherein the network comprises at least one of universal plug and play (UPnP), digital living network alliance (DLNA), or ZigBee.

5. The method of claim 1, wherein the response is received from the plurality of terminal devices that meet configured standards.

6. The method of claim 5, wherein the configured standards are determined based on at least one of the second direction in which the control device is directed, or the location of the corresponding terminal device.

7. The method of claim 1, wherein the location comprises at least one of information received by a global positioning system (GPS) or information received by an indoor positioning system (IPS).

8. A control device of controlling at least one of a plurality of terminal devices, the control device comprising:

a transmitter configured to transmit a search request for controllable one or more terminal devices from among the plurality of terminal devices;

a receiver configured to receive, from each of the one or more terminal devices, a response corresponding to the transmitted search request, the response comprising a location of a corresponding terminal device and a first direction of the corresponding terminal device; and at least one processor configured to:

determine a second direction in which the control device is directed and a third direction from the control device to the one or more terminal devices based on the location of the corresponding terminal, and determine at least one terminal device that is controllable and positioned within a range of a configured angle based on the first direction, the second direction and the third direction.

9. The apparatus of claim 8, wherein the location comprises information of a distance between the corresponding terminal device and the control device.

10. The apparatus of claim 9, wherein the at least one processor is further configured to:

determine the one or more terminal devices positioned within a configured distance from the control device, and determine the one or more terminal devices positioned within the configured distance as the at least one terminal device that is controllable.

11. The apparatus of claim 8, wherein the transmitting of the search request is performed by a network, and wherein the network comprises at least one of universal plug and play (UPnP), digital living network alliance (DLNA), or ZigBee.

12. The apparatus of claim 8, wherein the response is received from the plurality of terminal devices that meet configured standards.

13. The apparatus of claim 12, wherein the configured standards are determined based on at least one of the second direction in which the control device is directed, or the location of the corresponding terminal device.

14. A method in which a control device controls at least one of a plurality of terminal devices, the method comprising:

transmitting a search request for searching controllable one or more terminal devices from among the plurality of terminal devices;

receiving, from each of the one or more terminal devices, a response corresponding to the transmitted search request, the response includes a location of a corresponding terminal device comprising at least one of an absolute location and information for determining a relative location of the corresponding terminal device from the control device, and a first direction in which that an output part of the corresponding terminal device is directed;

determining a second direction in which the control device is directed and a third direction from the control device to the one or more terminal devices based on the location of the corresponding terminal;

determining at least one terminal device that is controllable and positioned within a range of a configured angle based on the first direction, the second direction and the third direction; and controlling the determined at least one terminal device that is controllable and positioned within the range of the configured angle, wherein the location is determined by different methods depending on whether the corresponding terminal device is positioned outside or positioned inside.

15. The method of claim 1, wherein the location includes at least one of an absolute location and information for determining a relative location of the corresponding terminal device from the control device, and wherein the location is determined by different methods depending on whether the corresponding terminal device is set to be fixed, positioned outside or positioned inside.

16. The method of claim 1, wherein the output part of the corresponding terminal device includes a display screen.

17. The apparatus of claim 8, wherein the location includes at least one of an absolute location and information for determining a relative location of the corresponding terminal device from the control device, and wherein the location is determined by different methods depending on whether the corresponding terminal device is set to be fixed, positioned outside or positioned inside.

18. The apparatus of claim 8, wherein the output part of the corresponding terminal device includes a display screen, and wherein the at least one terminal device that is positioned within the range of the configured angle is determined based on a first angle between the second direction and the third direction, and a second angle between the second direction and the first direction.

19. The method of claim 1, further comprising:

controlling the determined at least one terminal device that is controllable and positioned within the range of the configured angle.

20. The method of claim 1, wherein the determining the at least one terminal device that is controllable and positioned within the range of the configured angle comprises determining the at least one terminal device that is positioned within the range of the configured angle based on a first angle between the second direction and the third direction, and a second angle between the second direction and the first direction.

* * * * *